US010913635B2

(12) United States Patent
Webster

(10) Patent No.: US 10,913,635 B2
(45) Date of Patent: Feb. 9, 2021

(54) SYSTEM FOR CHAIN CHORDAL ACTION SUPPRESSION

(71) Applicant: Pflow Industries, Inc., Milwaukee, WI (US)

(72) Inventor: Mark R. Webster, Hubertus, WI (US)

(73) Assignee: Pflow Industries, Inc., Milwaukee, WI (US)

( * ) Notice: Subject to any disclaimer, the term of this patent is extended or adjusted under 35 U.S.C. 154(b) by 267 days.

(21) Appl. No.: 16/219,313

(22) Filed: Dec. 13, 2018

(65) Prior Publication Data

US 2019/0112155 A1 Apr. 18, 2019

Related U.S. Application Data

(63) Continuation of application No. 16/219,313, filed on Jun. 16, 2016, now Pat. No. 10,183,840.

(60) Provisional application No. 62/181,917, filed on Jun. 19, 2015.

(51) Int. Cl.

| | |
|---|---|
| ***B66B 7/06*** | (2006.01) |
| ***B66B 11/04*** | (2006.01) |
| ***B66B 5/12*** | (2006.01) |

(52) U.S. Cl.

CPC ..... *B66B 7/066* (2013.01); *B66B 5/12* (2013.01); *B66B 11/0469* (2013.01)

(58) Field of Classification Search

CPC ..... B66B 7/006; B66B 5/12; B66B 11/0469
See application file for complete search history.

(56) References Cited

U.S. PATENT DOCUMENTS 449,495 A * 3/1891 Rose ..... B66B 11/0469 187/255
495,234 A * 4/1893 Thorp ..... B66B 11/0469 187/255
611,693 A * 10/1898 Lundell et al. ..... B66B 11/0469 187/255
1,197,529 A * 9/1916 Miller ..... B66B 5/12 187/348

(Continued)

OTHER PUBLICATIONS

U.S. Appl. No. 449,495, filed Mar. 31, 1891, in the name of Milton T. Rose.

(Continued)

*Primary Examiner* — Michael A Riegelman
(74) *Attorney, Agent, or Firm* — Andrus Intellectual Property Law, LLP

(57) ABSTRACT

A vertical lift conveyor for lifting materials between different vertical levels. The vertical lift conveyor includes a pair of spaced uprights and a carriage that moves vertically along the spaced uprights. The vertical lift conveyor includes a drive assembly including a drive motor coupled to a drive shaft. Each end of the drive shaft includes a first sprocket and a second sprocket that each engages one of a pair of lift chains. The first and second sprockets each include a plurality of teeth (N). The first and second sprockets are offset from each other 180/N°. The offset between the first and sprockets creates sinusoidal velocity profiles for the two chains that are out of phase with each other. A connection block is used to connect the pair of lift chains to each side of the carriage combines the lift chain velocities into a linear vertical velocity for the carriage.

14 Claims, 12 Drawing Sheets

(56) References Cited

U.S. PATENT DOCUMENTS 4,222,461 A * 9/1980 Gunti ..... B66F 7/02 187/255
4,674,938 A * 6/1987 Van Stokes ..... E04H 6/06 187/207
5,205,379 A * 4/1993 Pfleger ..... B66B 9/04 182/141
5,221,075 A * 6/1993 Habicht ..... B66B 5/12 187/367
8,075,237 B2 12/2011 Webster et al.
9,682,844 B2 * 6/2017 Conrad ..... B66F 9/02
2006/0151255 A1 * 7/2006 Payne ..... B66B 7/066 187/351
2006/0180399 A1 * 8/2006 Stanislao ..... B66B 9/0853 187/201
2010/0111653 A1 * 5/2010 Webster ..... B66B 9/04 414/331.14
2010/0119338 A1 * 5/2010 Webster ..... E04H 6/18 414/239
2011/0014017 A1 * 1/2011 Webster ..... B65G 1/0407 414/267
2012/0279806 A1 * 11/2012 Webster ..... B66B 1/06 187/289
2015/0158700 A1 * 6/2015 Conrad ..... B66F 9/02 187/254
2016/0368737 A1 * 12/2016 Webster ..... B66B 7/066
2017/0050822 A1 * 2/2017 Wurth ..... B66B 5/04

OTHER PUBLICATIONS

U.S. Appl. No. 495,234, filed Apr. 11, 1893, in the name of Thomas J. Thorp.
U.S. Appl. No. 611,693, filed Oct. 4, 1898, in the name of Robert Lundell et al.

* cited by examiner

SYSTEM FOR CHAIN CHORDAL ACTION SUPPRESSION

CROSS REFERENCE TO RELATED APPLICATION

The present application is a continuation of U.S. patent application Ser. No. 15/184,214, filed Jun. 16, 2016, which has now issued as U.S. Pat. No. 10,183,840 and is based on and claims priority to U.S. Provisional Patent Application Ser. No. 62/187,919, filed Jun. 19, 2015, the disclosures of which are incorporated herein by reference.

BACKGROUND

Vertical reciprocating conveyors are employed by warehouses, factories, and the like to convey materials between different vertical levels. The typical vertical conveyor includes a supporting structure or frame and a carriage, which is adapted to support a cargo or load, is guided for vertical movement on the supporting structure. The carriage can be moved upwardly and downwardly on the structure by either a mechanical or hydraulic drive. In one common form of vertical conveyor, the carriage or platform is lifted and lowered by drive chains that are located on opposite sides of the carriage. Each drive chain passes over a drive sprocket that is joined to the drive shaft on opposite ends of the drive shaft. The drive shaft is rotated by a drive motor and lifting and lowering is accomplished through operation of the drive motor.

SUMMARY

The present disclosure generally relates to a vertical lift conveyor. More specifically, the present disclosure relates to a vertical lift conveyor that includes a frame having at least a pair of spaced vertical uprights. The vertical lift conveyor includes a carriage that is mounted for vertical movement along the pair of spaced vertical uprights. The vertical lift conveyor includes a drive assembly including a drive motor and a drive shaft that is coupled to the drive motor. The drive shaft extends between a first end and a second end.

A first sprocket and a second sprocket are mounted to each of the first and second ends of the drive shaft. A first lift chain travels around the first sprocket and a second lift chain travels around the second sprocket. One end of the first and second lift chains are coupled to the carriage such that rotation of the drive shaft causes the carriage to move vertically along the pair of spaced vertical uprights.

In accordance with one aspect of the present disclosure, the first and second sprockets each include a plurality (N) of teeth. The first and second sprockets are rotationally offset from each other such that the first plurality of teeth is positioned 180/N° out of phase from the second plurality of teeth. The offset between the teeth of the first and second sprockets reduce the vertical pulsation of the conveyor during vertical movement of the carriage.

In accordance with another aspect of the present disclosure, the first and second lift chains are each connected to a connection block. The connection block, in turn, is connected to the carriage through a master chain. The connection block used to connect each of the first and second lift chains to the carriage includes a pivotal connection to the master chain such that the connection block can compensate for the offset between the teeth of the first and second sprockets.

The present disclosure further relates to a drive assembly that is used with a vertical lift conveyor that includes a frame having at least a pair of spaced vertical uprights and a carriage that is mounted for vertical movement along the uprights. The drive assembly includes a drive motor and a drive shaft driven by the drive motor. A pair of first sprockets and a pair of second sprockets are mounted to each of the first and second ends of the drive shaft. A pair of first lift chains travels around each of the first sprockets and a pair of second lift chains travel around each of the second sprockets. The first and second sprockets each include N teeth, wherein the first plurality of teeth on the first sprocket are offset from the second plurality of teeth on the second sprocket when the first and second sprockets are mounted to the drive shaft. The first plurality of teeth is positioned 180/N° out of phase from the second plurality of teeth.

In accordance with another aspect of the present disclosure, the first and second lift chains are each connected to a connection block. The connection block, in turn, is connected to the carriage through a master chain. The connection block used to connect each of the first and second lift chains to the carriage includes a pivotal connection to the master chain such that the connection block can compensate for the offset between the teeth of the first and second sprockets.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
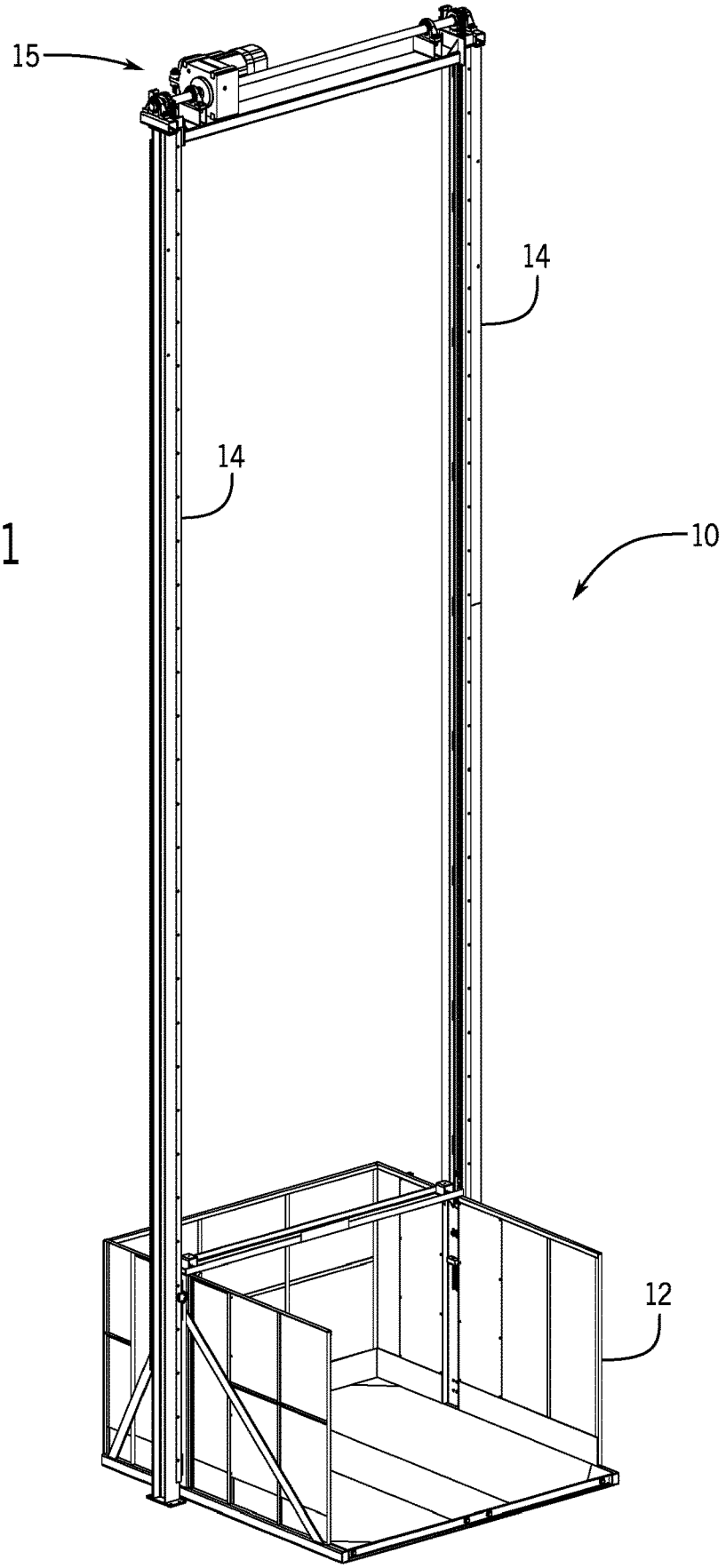
FIG. 1 is a perspective view of a vertical lift conveyor incorporating the drive assembly of the present disclosure.

FIG. 1 illustrates a vertical lift conveyor 10 constructed in accordance with the present disclosure. The vertical lift conveyor 10 includes a movable carriage 12 that is movable vertically along a pair of spaced vertical uprights 14. In some embodiments 12, the carriage 12 is movable between multiple floors of a building. As an illustrative example, the vertical conveyor 10 shown in FIG. 1 could service four separate floors within a facility. The vertical lift conveyor 10 includes a drive assembly 15 that is operable to raise and lower the carriage 12 along the vertical uprights 14.

Figure 2:
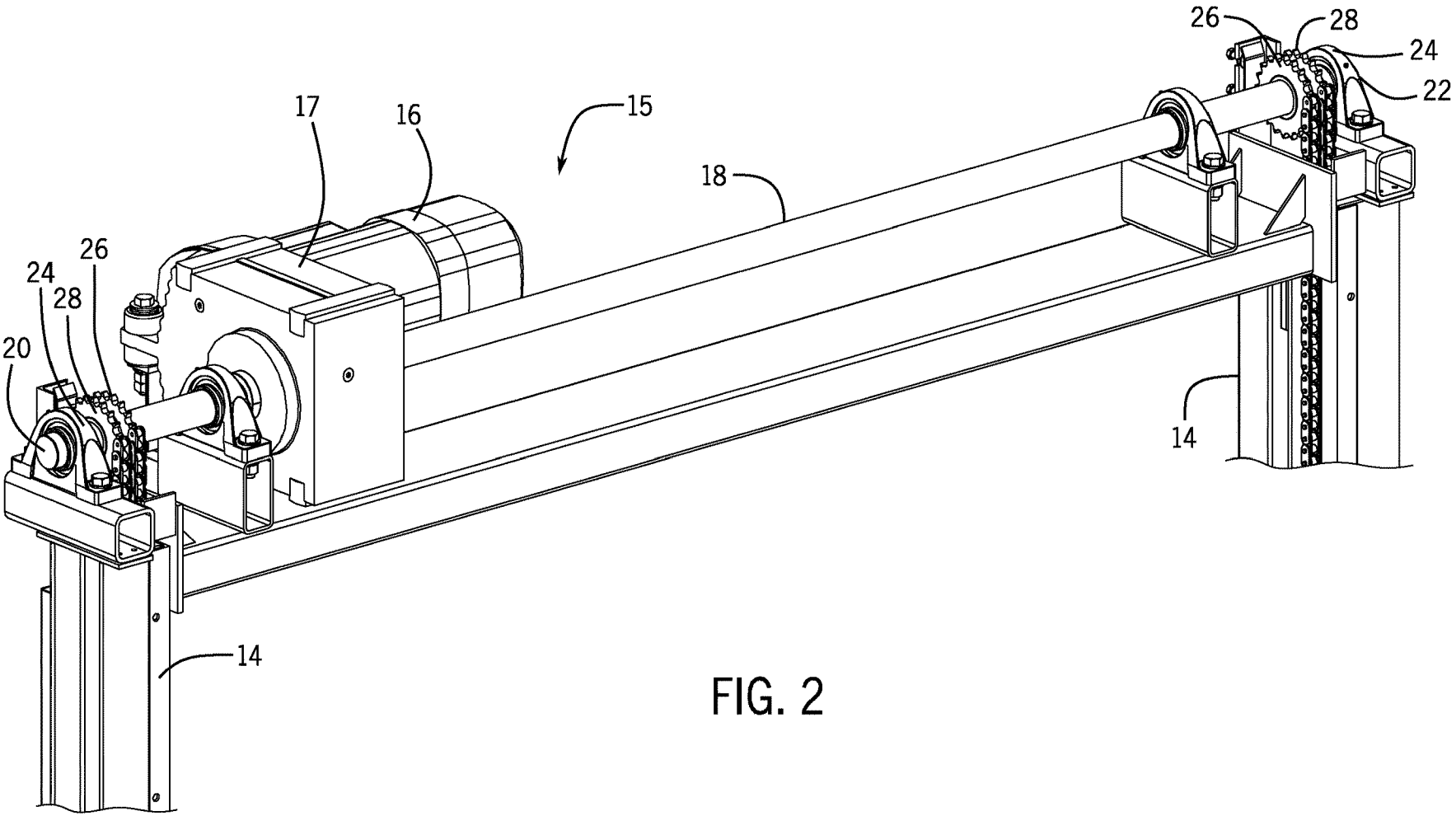
FIG. 2 is a magnified view showing the drive assembly including a pair of drive sprockets and a pair of lift chains on each side of the vertical conveyor.

As shown in FIG. 2, the drive assembly 15 of the vertical lift conveyor includes a drive motor 16 that operates through a gear box 17 to rotate a drive shaft 18. The drive shaft 18 extends between a first end 20 and a spaced second end 22. The first and second ends 20, 22 are each supported by one or more pillow blocks 24 that each include an internal bearing that rotatably supports the drive shaft 18.

In accordance with the present disclosure, both the first and second ends of the drive shaft include a pair of drive sprockets 26, 28. Specifically, each end of the drive shaft 18 includes a first, inner sprocket 26 and a second, outer sprocket 28. The inner and outer sprockets 26, 28 are securely mounted to the drive shaft 18 such that the inner and outer sprockets 26, 28 rotate with the rotation of the drive shaft 18.

Figure 3:
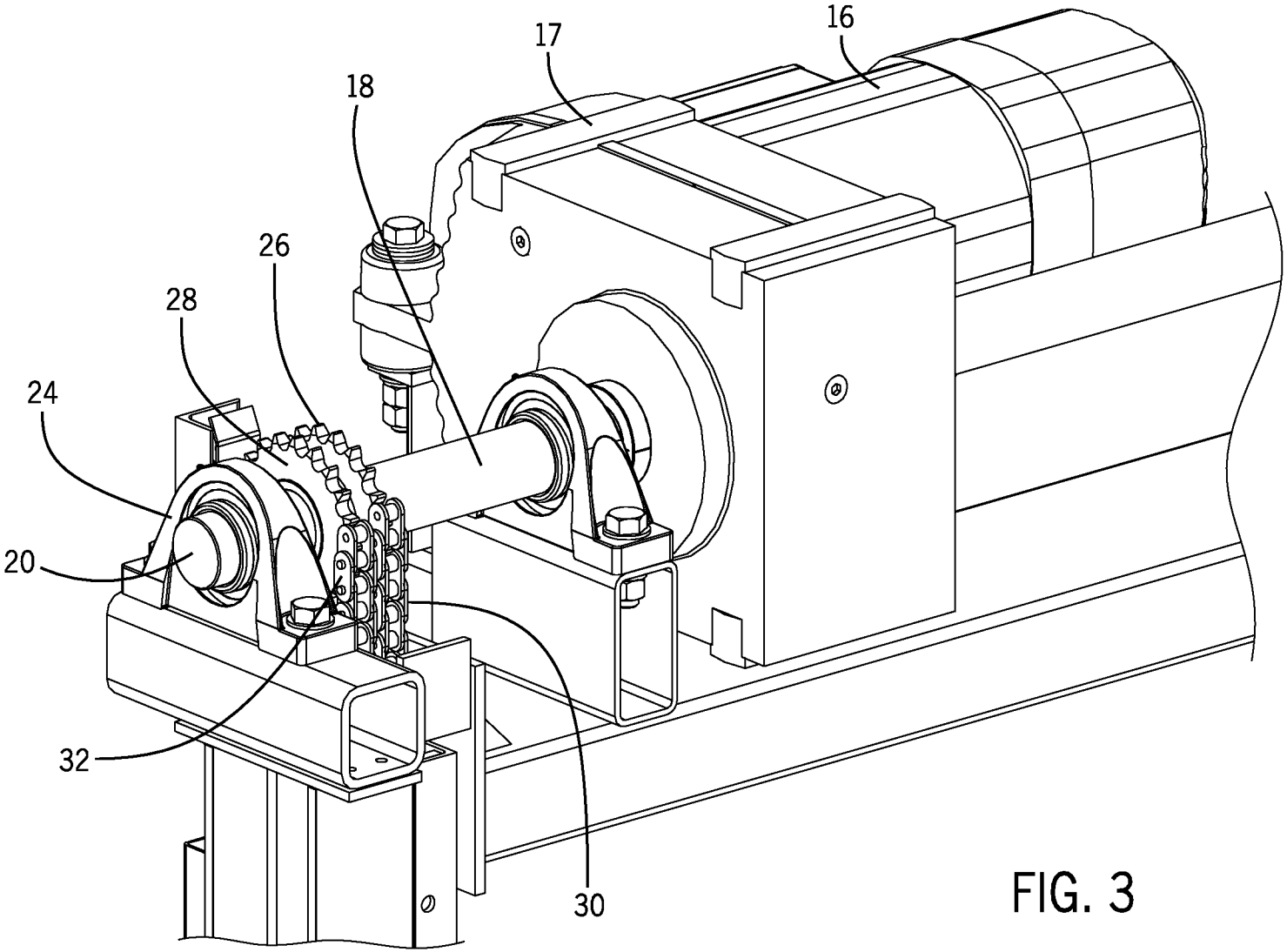
FIG. 3 is a further magnified view showing the pair of drive sprockets and lift chains.

As can be seen in FIG. 3, the inner drive sprocket 26 engages a first, inner lift chain 30 while the outer sprocket 28 receives a second, outer lift chain 32. As can be seen in the magnified view of FIG. 4, the inner and outer chains 30, 32 are identical to each other and are each formed from a series of links 33 joined to each other in a convention manner. Each of the lift chains passes around the outer circumference of the respective sprocket in a conventional manner.

Figure 4:
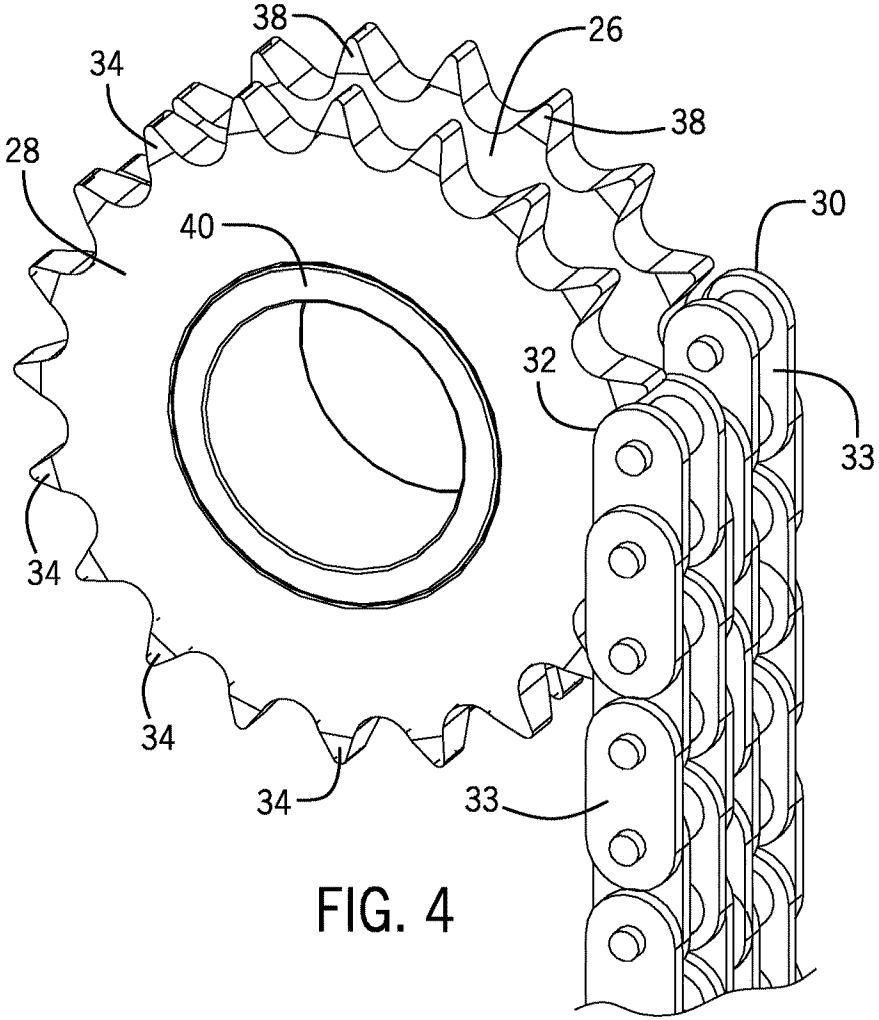
FIG. 4 is a perspective view showing the offset between the pair of drive sprockets.

As illustrated in FIG. 4, the outer sprocket 28 includes a number (N) of teeth 34 that are spaced equally around the outer circumference of the outer sprocket 28. Each of the teeth 34 engages one of the plurality of links 33 of the outer chain 32. The inner sprocket 26 includes a corresponding number (N) of teeth 38 spaced around the outer circumference of the inner sprocket 26. The number of teeth (N) on each of the inner and outer sprockets can vary as long as each of the inner and outer sprockets have the same number of teeth. In the embodiment shown, the inner and outer sprockets 26, 28 are identical to each other.

Figure 5:
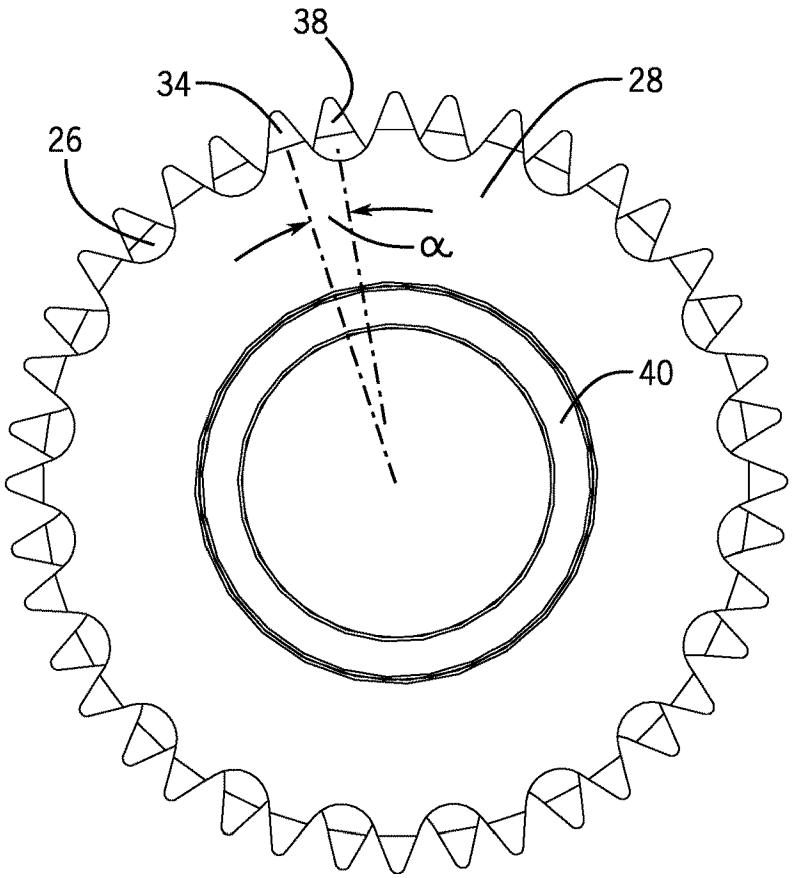
FIG. 5 is an end view showing the offset between the teeth of the pair of drive sprockets.

As can be understood in FIG. 5, the inner sprocket 26 and the outer sprocket 28 are oriented with the teeth out of phase from each other. Specifically, the teeth 34 on the outer sprocket 28 are out of phase with the teeth 38 on the inner sprocket by 180/N degrees, where N is the number of teeth on the sprocket. This orientation can be clearly seen in FIG. 5 and the angle between the teeth 34 and 38 is shown by reference character "a".

As illustrated in FIGS. 4 and 5, the inner and outer sprockets 26, 28 are each mounted to a center hub 40. The inner and outer sprockets are joined to the center hub with the two sprockets rotated relative to each other. Once the inner and outer sprockets are joined to the center hub 40, the center hub 40 is locked into place at one of the first and second ends of the rotating drive shaft 18. In this manner, both the first and second ends of the drive shaft receive the pair of sprockets to drive the pair of lift chains in the manner to be described below.

Figure 6:
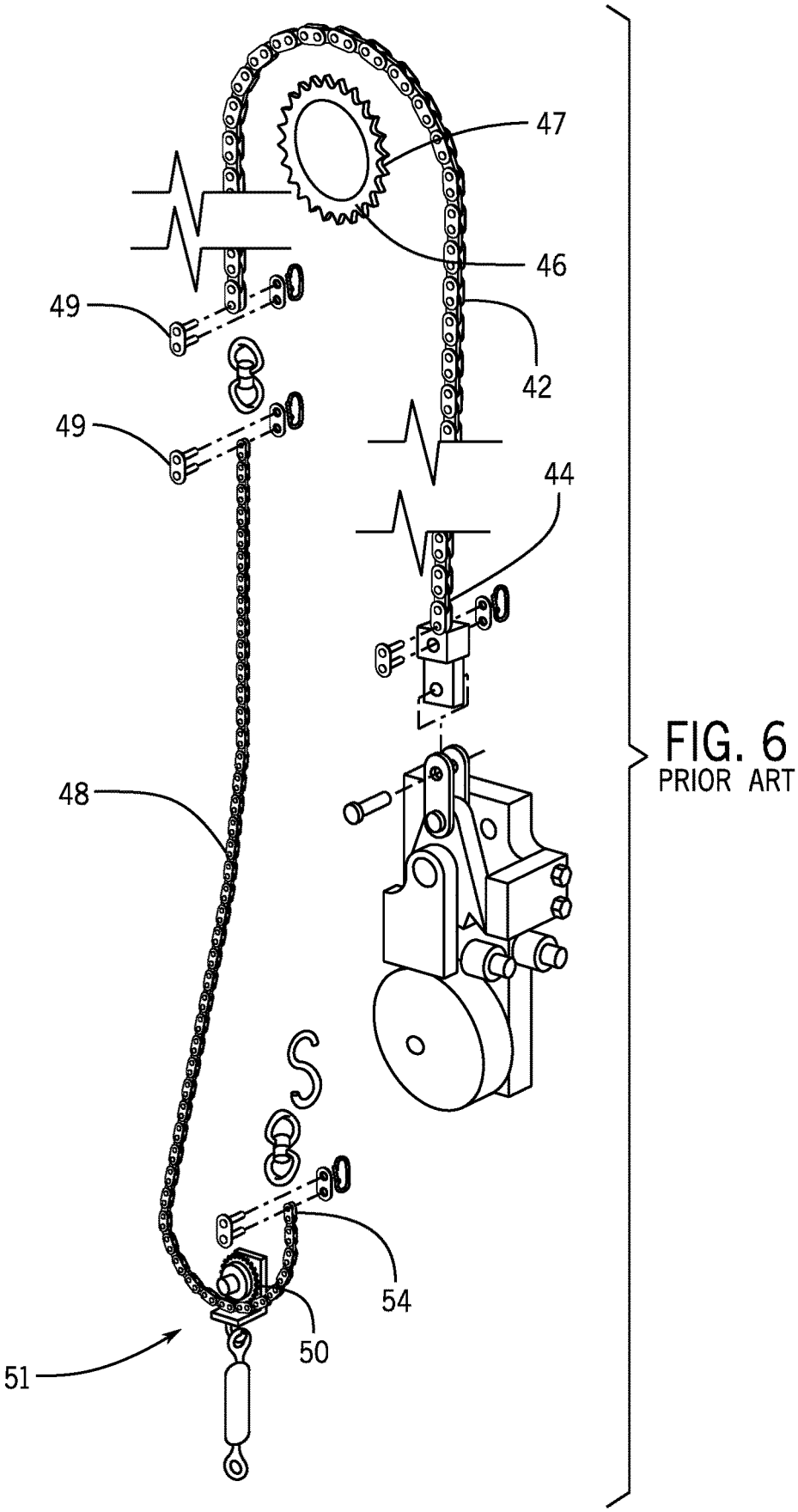
FIG. 6 PRIOR ART
FIG. 6 is a schematic illustration of a prior art lift chain used in a vertical lift conveyor.
Figure 7:
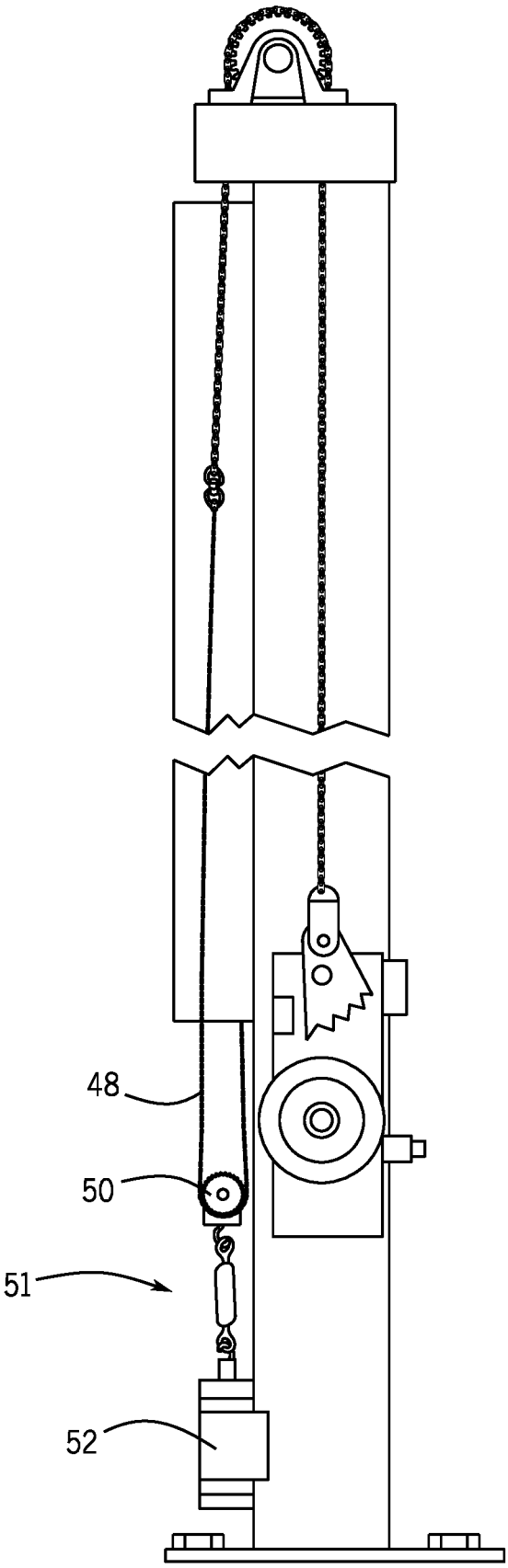
FIG. 7 PRIOR ART
FIG. 7 is a side view of the prior art lift chain shown in FIG. 6.
Figure 8:
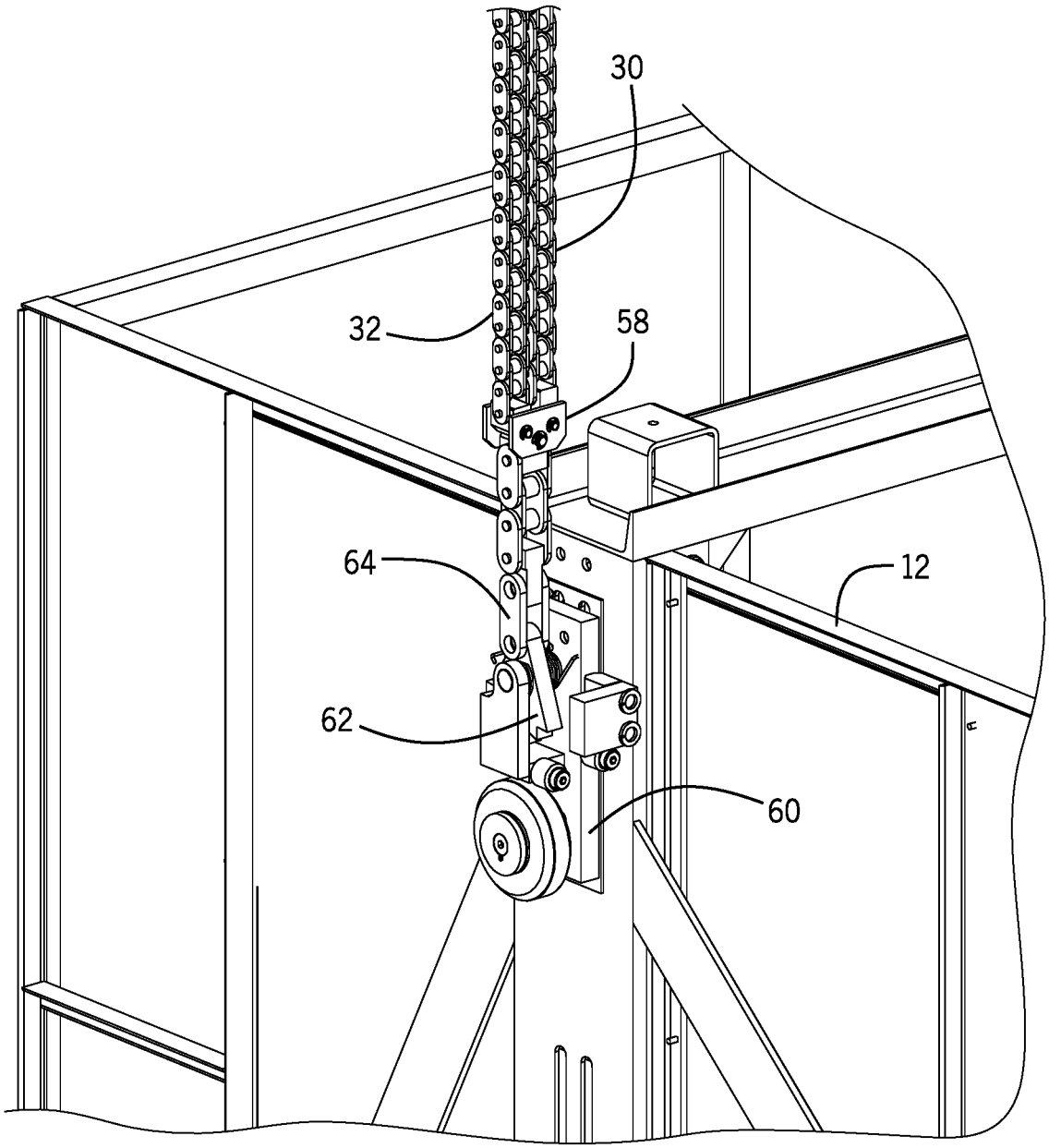
FIG. 8 is a view showing the connection between the pair of lift chains and the carriage.
Figure 9:
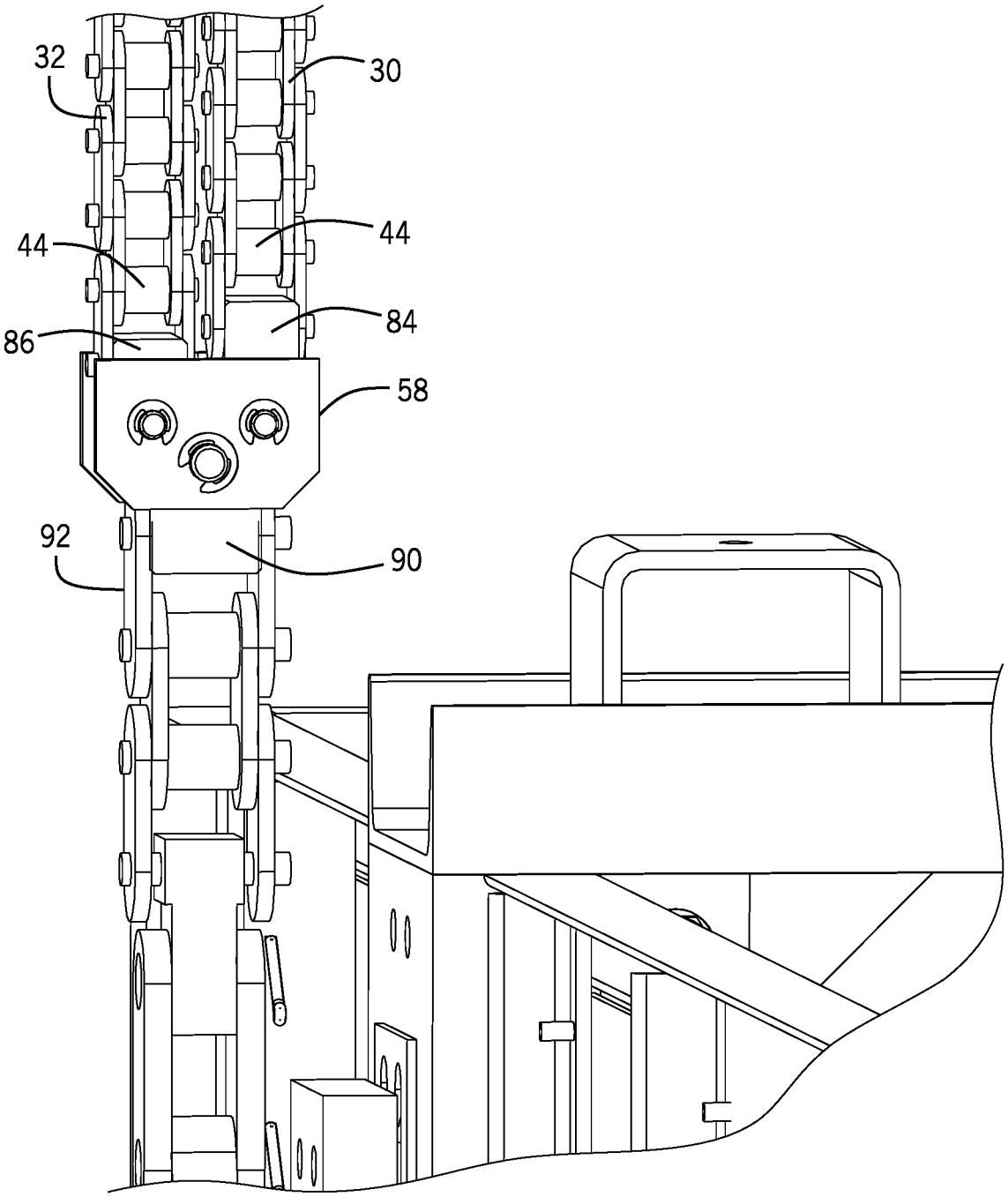
FIG. 9 is a end view showing the interconnection between the pair of lift chains and the carriage.
Figure 10:
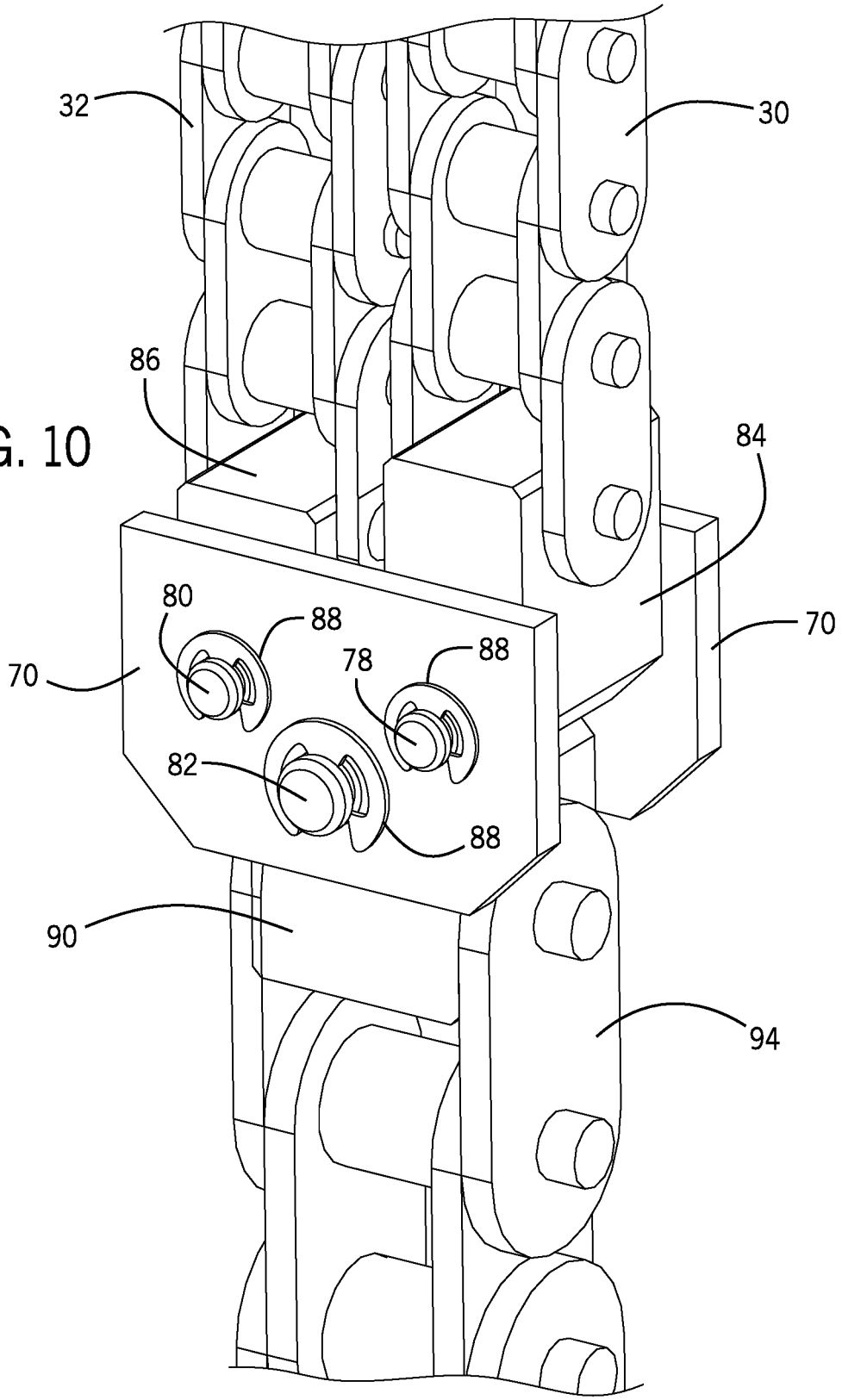
FIG. 10 is a magnified view showing the interconnection between the pair of lift chains and the connection block.

In prior art vertical lift conveyors, the drive assembly of the conveyor included a single lift chain 42, such as shown in FIG. 6. A first end 44 of the lift chain 42 is securely attached to the carriage and the chain 42 passed over a single sprocket 46 having a plurality of teeth 47. The lift chain 42 is connected to an attachment chain 48 by a pair of attachment links 49 and a connector 51. The attachment chain 48 passes over a lower sprocket 50. As illustrated in FIG. 7, a counterweight 52 is attached to the lower sprocket 50 and forms part of a chain tensioner assembly 51. A second end 54 of the attachment chain 48 is connected to the carriage. In this manner, as the drive motor rotated the sprocket 46, the rotating sprocket 46 engaged the heavy weight lift chain 42 to raise and lower the carriage along the pair of spaced vertical uprights.

Figure 12:
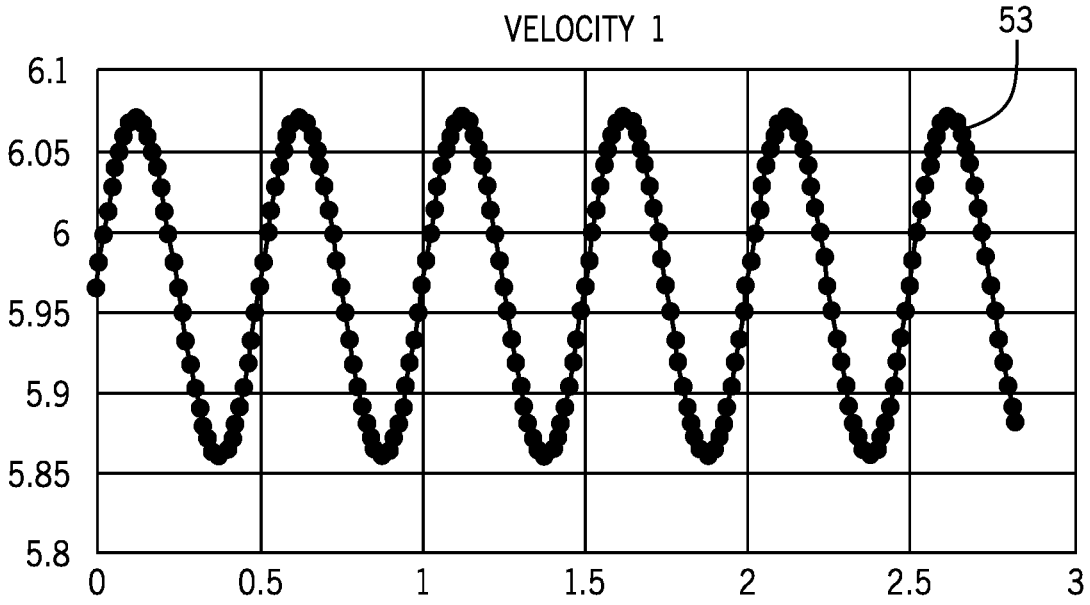
FIG. 12 is a graph illustrating the velocity of the first lift chain.

In prior vertical lift conveyors, such as shown in FIGS. 6 and 7, the lift chain 42 driven by the sprocket 46, which is rotating at a constant angular velocity, does not travel at a constant linear velocity. Since the lift chain 42 is made up of straight sections (links), the chain links create a polygon when engaged on the sprocket 46. This results in a sinusoidal linear velocity profile, such as shown in FIG. 12. This velocity profile creates problems when the vertical lift conveyor is in operation since the velocity profile introduces vertical pulsations. Since the vertical lift conveyor consists of elastic members suspending a mass, a natural or resonant frequency of the chain/carriage system can be calculated.

In a worst case scenario, the frequency of the vertical pulsations produced by the single lift chain drive matches the natural frequency of the chain/carriage system, and resonance occurs. During such resonance, the pulsations will be amplified and cause significant vertical oscillations in the carriage. Further compounding this problem is that the frequency of the chain/carriage system will change depending upon the amount of payload on the carriage. Thus, it is difficult to create a design that limits the vertical pulsations due to the unknown weight supported by the carriage.

One concept for reducing the vertical pulsations is to increase the number of teeth on the sprocket 46, which can reduce the amplitude of the pulses. However, such a concept will not eliminate the pulses but will only reduce the vertical amplitude of the pulses.

In accordance with the present disclosure, the single drive sprocket 46 and single drive chain 42 shown in FIG. 6 have been replaced by the pair of drive sprockets 26, 28 and the pair of drive chains 30, 32 as shown in FIGS. 2-5.

Figure 13:
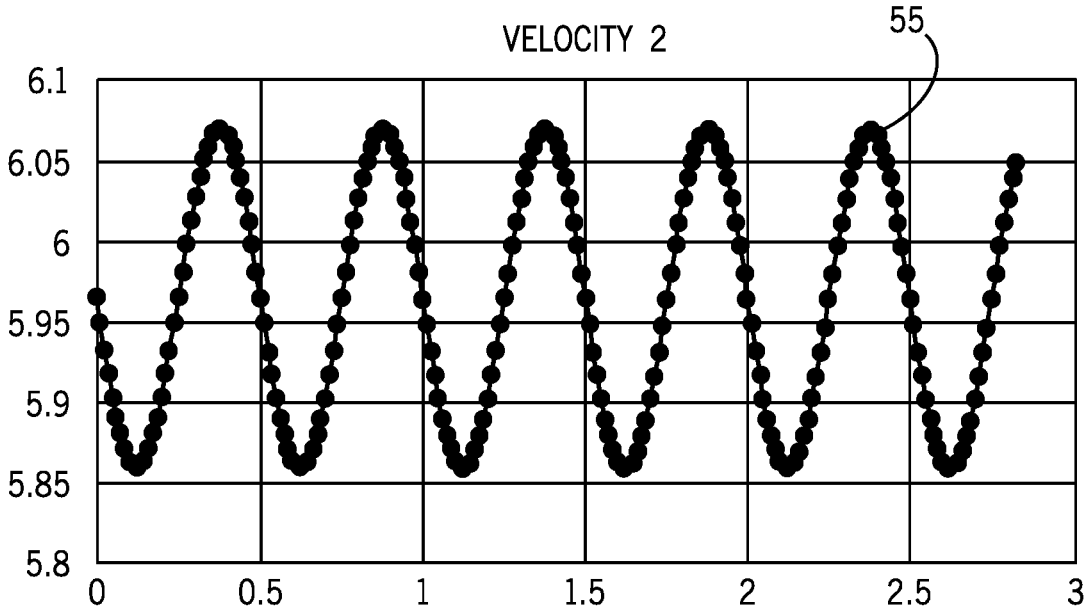
FIG. 13 is a graph illustrating the velocity of the second lift chain.
Figure 14:
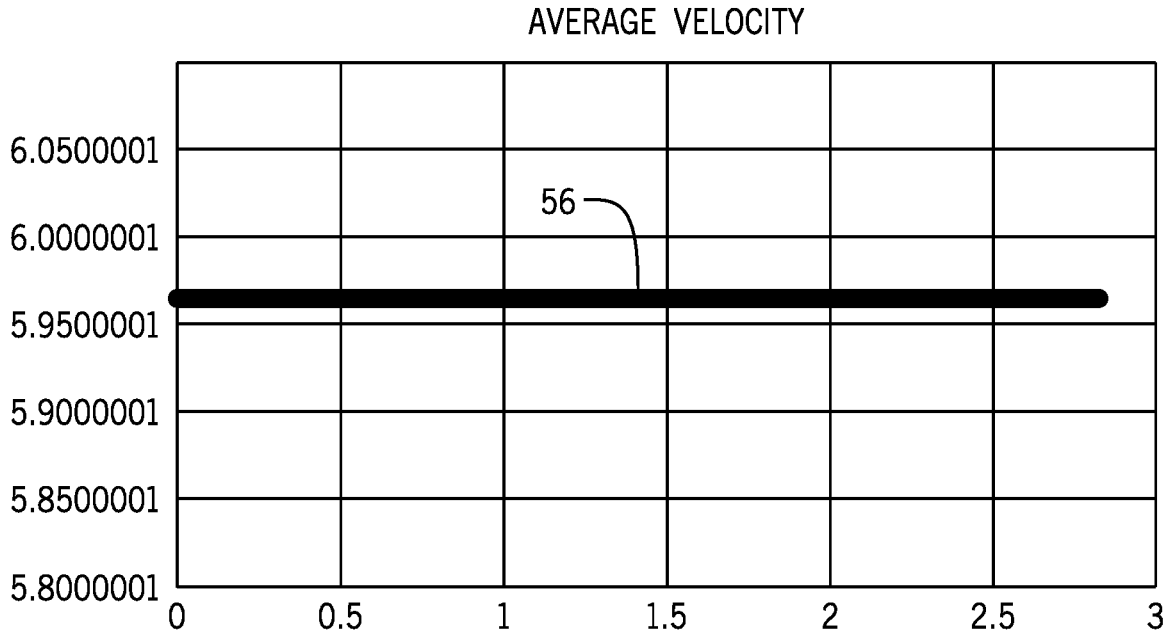
FIG. 14 is a graph showing the resulting velocity of the pair of lift chains.

As described previously, the teeth on the pair of drive sprockets 26, 28 are 180/N° out of phase, which causes the vertical pulsations created by each of the separate chain/sprocket combinations to cancel each other out. FIG. 12 illustrates the velocity profile 53 that represents the inner lift chain 30 while FIG. 13 is a velocity profile 55 that represents the outer lift chain 32. Both of these two velocity profiles 53, 55 are sinusoidal. As can be understood in the velocity profiles of FIGS. 12 and 13, the sinusoidal velocity profiles are 180° out of phase with each other due to the orientation of the teeth on the inner and outer sprockets. The resulting velocity profile, which is shown in FIG. 14, is a generally constant value, represented by line 56. The constant average velocity profile reduces the sinusoidal pulsations that were present in the prior art system shown in FIG. 6 and represented by the single velocity profile 53 in FIG. 12.

Referring now to FIGS. 8-11, the first end 44 of the inner lift chain 30 and the first end 44 of the outer lift chain 32 are connected to a connection block 58. The connection block 58, in turn, is connected to a standard wheel block 60 of the carriage 12. The wheel block 60 includes a safety cam 62 connected to a master link 64.

Figure 11:
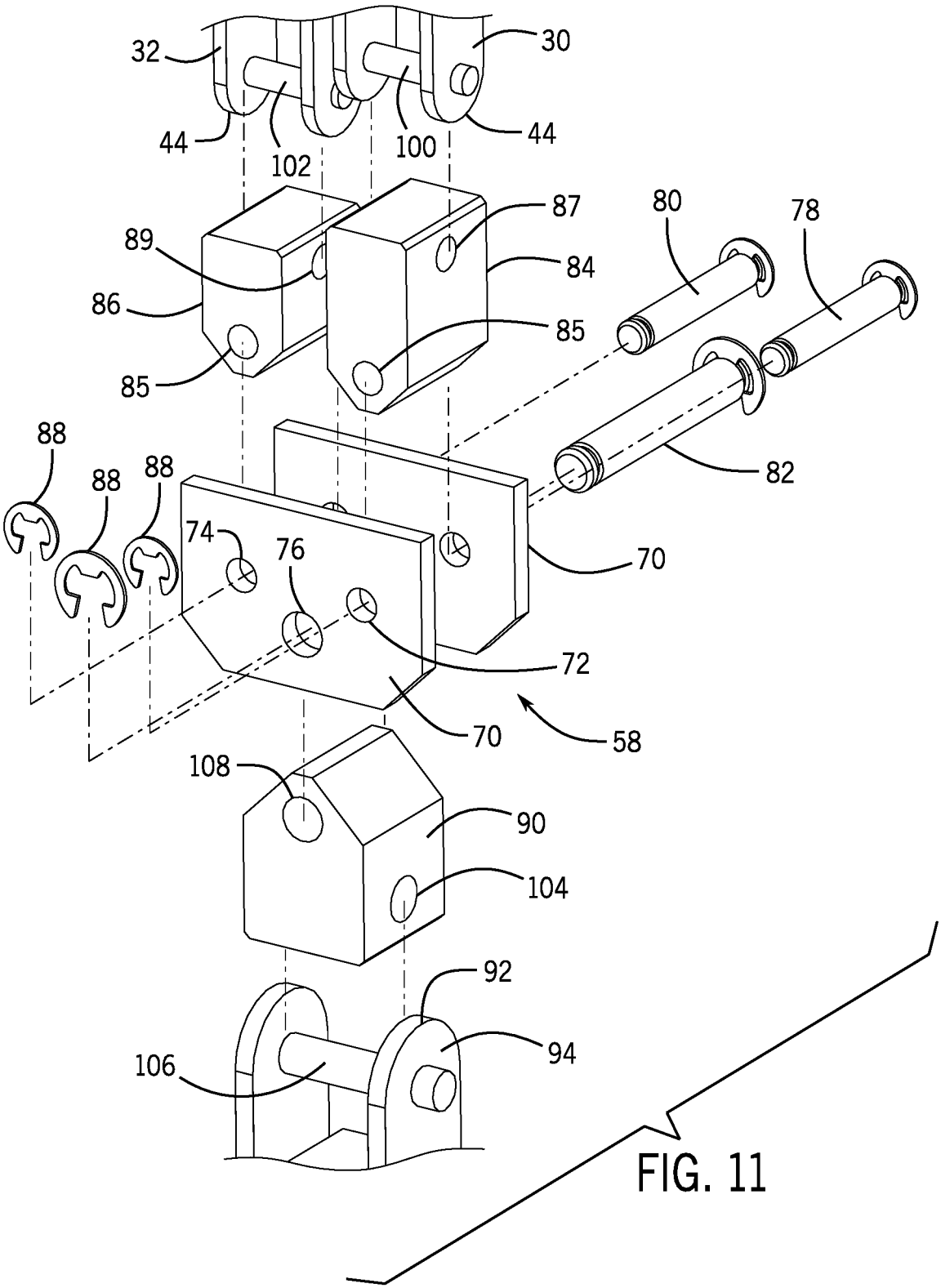
FIG. 11 is an exploded view showing the connection block and the pair of lift chains.

As shown best in FIG. 11, the connection block 58 includes a pair of outer plates 70 that each includes a series of holes 72, 74 and 76 that are positioned and sized to receive one of the pins 78, 80 or 82. The connection block includes a pair of chain blocks 84, 86. The first chain block 84 receives the first end 44 of the inner lift chain 30 while the second chain block 86 receives the first end 44 of the outer lift chain 32. As can best be seen in FIG. 11, the first chain block 84 has a height that is greater than the height of the second chain block 86. Each of the first and second chain blocks 84, 86 includes a lower pin opening 85 that is aligned with one of the holes 72, 74 formed in the outer plates 70. Pins 78 and 80 hold the chain blocks 84, 86 between the pair of outer plates 70 and are held in place by one of the locking washers 88.

The first chain block 84 includes a chain hole 87 that receives the bottom link pin 100 at the first end 44 of the inner lift chain 30 while the second chain block 86 includes a chain hole 89 that received the bottom link pin 102 at the first end 44 of the outer lift chain 32. Since the first and second chain blocks 84, 86 have different heights, the first ends of the inner and outer lift chains are vertically offset from each other. The vertical offset allows the inner and outer lift chains to compensate for the radial offset between the teeth of the sprockets.

The connection block 58 further includes a master link block 90 that includes a pin opening 104 that received the link pin 106 at the first end 92 of the master chain 94. The master link block 90 is positioned between the pair of outer plates 70 and an upper pin opening 108 receives the center pin 82 and locking washer 88.

The entire connection block 58 creates the averaging of the velocity of the two lift chains 30 and 32 through the two upper pins 78, 80 and the lower, center pin 82. The connection block 58 is able to rotate about the center pin 82 as the inner and outer lift chains pass over the inner and outer sprockets. During operation of the vertical lift conveyor, each of the two upper pins 78, 80 has a velocity that is equal to the sinusoidal velocity of the corresponding lift chain 30, 32 connected to the pin, such as shown in FIGS. 12 and 13. The single center pin 82 travels at the average linear velocity, shown in FIG. 14. Since the single center pin 82 is connected to the carriage 12 through the master chain 94, the carriage 12 moves at the average linear velocity. The two pins 78, 80 are vertically offset from the center pin 82, which results in a small horizontal velocity that is expected to be negligible. Ideally, the two pins 78,80 and the center pin 82 are in horizontal alignment with each other, which eliminates the horizontal velocity. In the embodiment shown in the Figures, the two pins 78, 80 are vertically offset from the center pin 82 to reduce the size of the connection block 58. The connection block 58 allows the two lift chains 30, 32 to be coupled to the standard wheel block 60 of currently available vehicle lifts, such as the Series M available from Pflow Industries, Inc.

The system of the present disclosure can replace the single drive sprocket 46 and single drive chain 42 shown in FIG. 6 with a pair of drive sprockets and a pair of drive chains. The teeth on the pair of drive sprockets are positioned 180/N° out of phase from each other to eliminate pulsations created by the rotation of the drive chain over the drive sprocket.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A vertical lift conveyor, comprising:
- a frame including a pair of spaced vertical uprights that define a first side and a second side of the frame;
- a carriage mounted for vertical movement along the pair of spaced vertical uprights;
- a first inner drive sprocket and a first outer drive sprocket positioned at the first side of the frame;
- a second inner drive sprocket and a second outer drive sprocket positioned at the second side of the frame;
- a first inner lift chain positioned to travel around the first inner drive sprocket;
- a first outer lift chain positioned to travel around the first outer drive sprocket;
- a second inner lift chain positioned to travel around the second inner drive sprocket;
- a second outer lift chain positioned to travel around the second outer drive sprocket;
- a first connection block coupled to a first side of the carriage, wherein a first end of the first inner lift chain and a first end of the first outer lift chain are connected to the first connection block; and
- a second connection block coupled to a second side of the carriage, wherein a first end of the second inner lift chain and a first end of the second outer lift chain are connected to the second connection block.

2. The vertical lift conveyor of claim 1 wherein the first inner drive sprocket and the first outer drive sprocket rotate with each other and the second inner drive sprocket and the second outer drive sprocket rotate with each other.

3. The vertical lift conveyor of claim 2 wherein each of the first and second inner drive sprockets includes a first plurality of teeth and each of the first and second outer drive sprockets includes a second plurality of teeth, wherein the first plurality of teeth are offset from the second plurality of teeth.

4. The vertical lift conveyor of claim 1 wherein each of the first and second connection blocks is coupled to a first end of one of a pair of master chains, wherein a second end of each of the master chains is coupled to the carriage.

5. The vertical lift conveyor of claim 4 wherein the first end of each of the master chains is pivotally coupled to one of the first and second connection blocks by a center pin.

6. The vertical lift conveyor of claim 1 each of the first and second connection blocks includes a first chain block and a second chain block, wherein the first chain block is joined to the connection block by a first pin and the second chain block is joined to the connection block by a second pin.

7. The vertical lift conveyor of claim 6 wherein the first chain block and the second chain block have different heights such that the first end of the inner lift chain is offset from the first end of the outer lift chain.

8. A drive assembly for use with a vertical lift conveyor having a frame including a pair of spaced vertical uprights that define a first side and a second side of the frame and a carriage mounted for vertical movement along the uprights, the drive assembly comprising:
- a first inner drive sprocket and a first outer drive sprocket positioned at the first side of the frame;
- a second inner drive sprocket and a second outer drive sprocket positioned at the second side of the frame;
- a first inner lift chain positioned to travel around the first inner drive sprocket;
- a first outer lift chain positioned to travel around the first outer drive sprocket;

a second inner lift chain positioned to travel around the second inner drive sprocket;

a second outer lift chain positioned to travel around the second outer drive sprocket;

a first connection block coupled to a first side of the carriage, wherein a first end of the first inner lift chain and a first end of the first outer lift chain are connected to the first connection block; and a second connection block coupled to a second side of the carriage, wherein a first end of the second inner lift chain and a first end of the second outer lift chain are connected to the second connection block.

9. The drive assembly of claim 8 wherein the first inner drive sprocket and the first outer drive sprocket rotate with each other and the second inner drive sprocket and the second outer drive sprocket rotate with each other.

10. The drive assembly of claim 9 wherein each of the first and second inner drive sprockets includes a first plurality of teeth and each of the first and second outer drive sprockets includes a second plurality of teeth, wherein the first plurality of teeth are offset from the second plurality of teeth.

11. The drive assembly of claim 8 wherein each of the first and second connection blocks is coupled to a first end of one of a pair of master chains, wherein a second end of each of the master chains is coupled to the carriage.

12. The drive assembly of claim 11 wherein the first end of each of the master chains is pivotally coupled to one of the first and second connection blocks by a center pin.

13. The drive assembly of claim 8 wherein each of the first and second connection blocks includes a first chain block and a second chain block, wherein the first chain block is joined to the connection block by a first pin and the second chain block is joined to the connection block by a second pin.

14. The drive assembly claim 13 wherein the first chain block and the second chain block have different heights such that the first end of the inner lift chain is offset from the first end of the outer lift chain.

* * * * *